US006021841A

United States Patent [19]

Makino

[11] Patent Number: 6,021,841

[45] Date of Patent: Feb. 8, 2000

[54] METHOD OF PREDICTING INSUFFICIENT CHARGING OF GREEN SAND IN MOLDING PROCESS

[75] Inventor: Hiroyasu Makino, Toyokawa, Japan

[73] Assignee: Sintokogio, Ltd., Nagoya, Japan

[21] Appl. No.: 09/007,234

[22] Filed: Jan. 14, 1998

[30] Foreign Application Priority Data

Jan. 17, 1997 [JP] Japan ..... PO9-019770

[51] Int. Cl.[7] ..... B22C 9/02

[52] U.S. Cl. ..... 164/456; 164/4.1

[58] Field of Search ..... 164/456, 4.1, 19, 164/20, 21, 22, 37

[56] References Cited

U.S. PATENT DOCUMENTS 3,537,295 11/1970 Heimgartner ..... 164/456 X
5,589,650 12/1996 Flemming et al. ..... 164/456 X
5,609,198 3/1997 Kruse et al. ..... 164/456 X

FOREIGN PATENT DOCUMENTS 1455725 10/1966 France ..... 164/4.1

*Primary Examiner*—J. Reed Batten, Jr.
*Attorney, Agent, or Firm*—Limbach & Limbach L.L.P.

[57] ABSTRACT

The method includes the steps of (a) analyzing the porosity of the green sand, (b) analyzing the contact force acting between sand particles of the green sand, (c) analyzing the fluid force of air existing around the sand particles, (d) calculating the acceleration of the sand particles from the force acting on the sand particles, the force being comprised of the contact force, the fluid force, and the gravity of the particles, (e) analyzing equations of motion to obtain the velocity and position of the sand particles after a minute period of time, from the calculated acceleration, and (f) repeating the steps (a), (b), (c), (d), and (e) until the sand particles stop moving.

2 Claims, 2 Drawing Sheets

METHOD OF PREDICTING INSUFFICIENT CHARGING OF GREEN SAND IN MOLDING PROCESS

FIELD OF THE INVENTION

This invention relates to a method of predicting insufficient charging of green sand when a mold is produced from it.

DESCRIPTION OF THE PRIOR ART

Conventionally, insufficient charging of green sand is detected after a mold has been actually produced. Accordingly, to change or improve its bulk density, many repeated trials for molding have had to be made, and then data such as on a molding plan, conditions of molding, and the properties of the green sand, was modified. Thus, with such empirically-accumulated data, to some extent an optimum mold is produced. However, the empirically-accumulated data is of no use for a new application, for example, for new parts (products) to be cast or a new molding process, or new green sand that has new properties. Thus to obtain the optimum conditions for such a new application, many trials for molding must be carried out. This takes many hours. Further, when a mold is produced, the influences of bentonite or oolitics must be considered, and such influences cannot be predicted from the ordinary charging of powders.

The present invention has been achieved to resolve these problems. Its purpose is to provide a method of predicting insufficient charging of green sand in a molding process such as pressurized-air-applying type, blow type, and squeeze-type molding processes.

SUMMARY OF THE INVENTION

The method of this invention, to predict insufficient charging of green sand in green-sand molding, includes the steps of: analyzing the porosity of the green sand in relation to the degree it is charged; analyzing the contact force acting between the sand particles of the green sand; analyzing the fluid force of the air existing around the sand particles; calculating the acceleration of the sand particles from the force acting on the sand particles, which force is comprised of the contact force, the fluid force, and the gravity of the particles; analyzing equations of motion to obtain the velocity and position of the sand particles after a minute period of time, from the calculated acceleration; and repeating said steps of analyzing the porosity of the green sand, contact force, and fluid force, calculating the acceleration, and analyzing the equations of motion until the sand particles stop moving.

When an air flow is used in the green-sand molding, the method may further comprise a step of analyzing the air flow to obtain its velocity by using the data on the porosity obtained in the step of analyzing the porosity.

In the present invention the term "green-sand molding" generally means molding in which green sand is used and in which bentonite is used as a binder. Green-sand molding processes include a molding process by mechanical compacting, such as jolting or squeezing, by applying flowing air such as by an air flow, air impulses, or blowing, and combinations of these processes. Green sand is composed of silica sand, etc. as aggregates, plus layers of oolitics and bentonite which are formed around the aggregates.

In the present invention the term "a molding plan" means working drawings for producing a cast (product) from product drawings. Especially, this invention relates to a molding plan where the optimum charging can be carried out when a mold is produced. The term "conditions of molding" means conditions applied in a molding process, as, say, the air pressure or the pressure of squeezing in the pressurized-air-applying-type molding process. The "properties" of green sand generally include water content, permeability, and compressive strength.

DESCRIPTION OF THE PREFERRED EMBODIMENT

Figure 1:
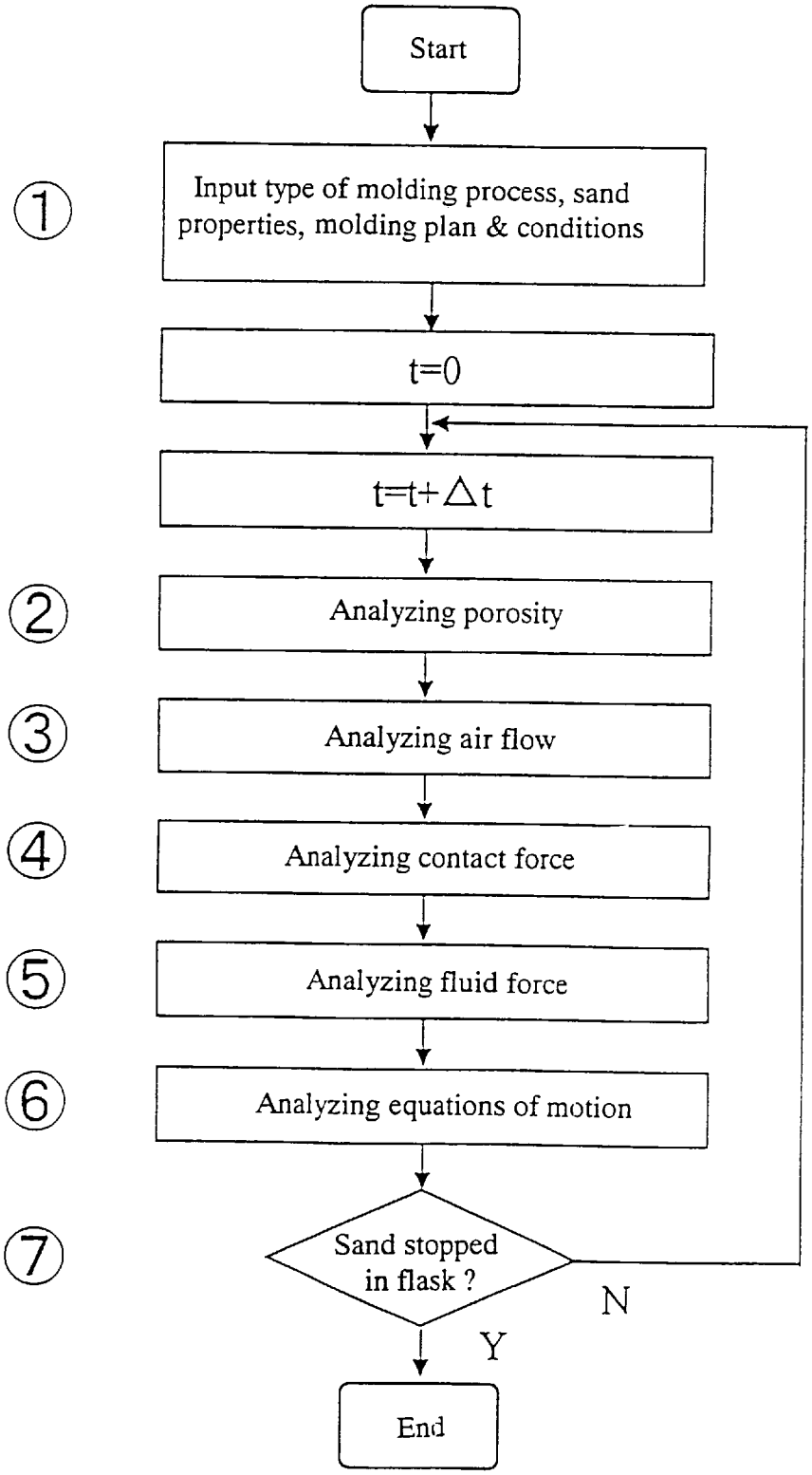
FIG. 1 is a flowchart showing the steps of analyzing a molding process.

In reference to the drawings, the preferred embodiment is now explained. FIG. 1 shows a flowchart of the steps of the method of the invention to analyze a molding process to predict the degree that the green sand will be charged. The embodiment is explained according to the flowchart.

In the first step, data on a molding process, molding plan, conditions of molding, and the properties of the green sand, is input. For an analysis, the volume of the silica sand that is used for producing a mold is divided into the number of particulate elements, each of which elements has the same diameter. The number of elements is determined depending on the needed degree of precision of the analysis. The diameter of the elements is then calculated. Similarly, the thickness of the layers of oolitics and bentonite to be used in the analysis is determined. In the embodiment, the distinct element method is used. This method gives a higher degree of precision for predicting than other methods.

Then, meshes are created for an analysis of porosity and an air flow. The term "meshes" denotes a grid that is necessary for calculations. The values of the velocity and porosity at the grid points are calculated. These meshes are also used for the analysis of the air flow.

In the second step the volume of the green sand in each mesh and the porosity of each mesh are calculated. The first and second steps together constitute one step for analyzing the porosity.

In the third step, the velocity of the air flow is obtained from a numerical analysis of an equation which takes its pressure loss into account if the molding process is the pressurized-air-applying-type or blow-type, where air is used.

The fourth step is one to analyze contact forces. This analysis calculates the distance of two given particles i, j and determines whether they contact each other. If they do contact, two vectors are defined. One is a normal vector, starting from the center of the particle (i) toward the center of the particle (j), and the other is a tangent vector which is directed 90 degrees counterclockwise from the normal vector.

Figure 2:
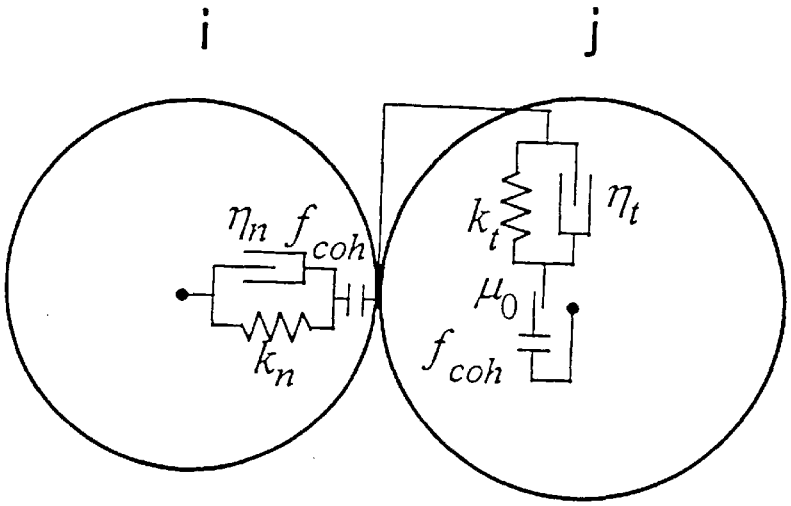
FIG. 2 shows a model of sand particles to obtain the contact force of the particles.

As in FIG. 2, by providing two contacting particles (distinct elements) with virtual springs and dash pots in normal and tangent directions, a contact force acting on the particle (i) from the particle (j) is obtained. The contact force is obtained as a resultant force of the normal and tangent contact forces.

In the fourth step, first, the normal contact force is obtained. The relative displacement of the particles i, j during a minute period of time is given by equation (1), using an increment in a spring force and an elastic spring factor (coefficient of a spring) that is proportional to the relative displacement.

$$\Delta e_n = k_n \Delta x_n \tag{1}$$

where, $\Delta x_n$: relative displacement of the particles i, j during a minute period of time $\Delta e_n$: an increment in a spring force $k_n$: an elastic spring (a spring constant) proportional to the relative displacement.

Further, the dash-pot force is given by equation (2) using a viscid dash pot (coefficient of viscosity) which is proportional to the rate of the relative displacement.

$$\Delta d_n = \eta_n \Delta x_n / \Delta t \tag{2}$$

where, $\Delta d_n$: dash-pot force $\eta_n$: a viscid dash pot (coefficient of viscosity) proportional to the rate of the relative displacement.

The normal spring force and dash-pot force of the particle (j) acting on the particle (i) at a given time are obtained by equations (3) and (4) respectively.

$$[e_n]_t = [e_n]_{t-\Delta\tau} + \Delta e_n \tag{3}$$

$$[d_n]_t = \Delta d_n \tag{4}$$

The tangent contact force is given by equation (5).

$$[f_n]_t = [e_n]_t + [d_n]_t \tag{5}$$

where, $[f_n]_t$: a normal contact force

Accordingly, the contact force acting on the particle (i) at a given time (t) is calculated by considering all contact forces from the other particles.

In the fourth step, secondly, the influences of oolitics and bentonite are considered. In other words, since green sand is comprised of aggregates such as silica sand, etc., plus layers of oolitics and bentonite, the respective values of the coefficient of the spring and the coefficient of the viscosity are selectively used according to the thickness of the layers relative to a contact depth (relative displacement) as in the following expressions:

$$\text{when } \delta < \delta_h \tag{6}$$

$$k_n = k_{nh} \tag{7}$$

$$\eta_n = \eta_{nh} \tag{8}$$

where, $\delta$: a contact depth (relative displacement)

$\delta_n$: thickness of the layers of oolitics and bentonite $$\text{when } \delta_h < \delta \tag{9}$$

$$k_n = k_{ns} \tag{10}$$

$$\eta_n = \eta_{ns} \tag{11}$$

where, $k_{nh}$: a spring constant acting between the layers of oolitics and bentonite $\eta_n$: in a coefficient of viscosity acting between the layers of oolitics and bentonite $k_{ns}$: a spring constant acting between the layer of oolitics and bentonite and silica sand particle $\eta_{ns}$: a coefficient of viscosity acting between the layer of oolitics and bentonite and silica sand particle Since a bond force acts between green sand particles that are used in this invention, such a bond force or strength must be considered. When the normal contact force is equal to or less than the bond strength, the normal contact force is deemed zero.

In the fourth step, thirdly, the tangent contact force is obtained. Assume that, similar to the normal contact force, the spring force of the tangent contact force is proportional to the relative displacement, and that the dash-pot force is proportional to the rate of the relative displacement. In this case the tangent contact force is given by equation (12).

$$[f_t]_t = [e_t]_t + [d_t]_t \tag{12}$$

Since the sand particles slip therebetween or they slip on a wall, the slippage is considered using Coulomb's Law, as follows:

$$\text{when } |[e_t]_t| > \mu_0 [e_n]_t + f_{coh} \tag{13}$$

$$[e_t]_t = (\mu_0 [e_n]_t + f_{coh}) \text{ sign } ([e_n]_t) \tag{14}$$

$$[d_t]_t = 0 \tag{15}$$

$$\text{when } |[e_t]_t| > \mu_0 [e_n]_t + f_{coh} \tag{16}$$

$$[e_t]_t = [e_t]_{t-\Delta\tau} + \Delta e_t \tag{17}$$

$$[d_t]_t = \Delta d_t \tag{18}$$

where, $\mu_0$: a coefficient of friction $f_{coh}$: bond strength sign (z): represents the positive or negative sign of a variable z.

In the fifth step, the forces acting on the particles are obtained. These forces are calculated by equation (19).

$$f_d = \tfrac{1}{2} \rho_g C_D A_S U_i^2 \tag{19}$$

where, $\rho_g$: the density of the fluid $C_D$: the coefficient of reaction $A_S$: the projected area $U_i$: the relative velocity.

When the forces are calculated for an airflow-applying-type molding process such as the pressurized-air-applying-type or blow-type, by using the data obtained from the analysis of the air flow in the third step, the relative velocities of the fluid and particles are calculated. When a molding process other than the airflow-applying-type is used, only the velocity of the moving sand particles is calculated.

In the sixth step, the acceleration caused by the collision or contact of the particles is obtained by equation (20) using the forces acting on the particles, i.e., the contact forces, coefficient of reaction, and gravity.

$$\dot{r} = \frac{1}{m}(f_c + f_d) + g \tag{20}$$

Also, when the particles collide obliquely (at an angle), rotations are produced. The angular acceleration of the rotations is given by equation (21).

$$\dot{\omega} = \frac{T_c}{I} \tag{21}$$

where, r: a position vector m: the mass of the particle $f_c$: contact force $f_d$: fluid force g: gravitational acceleration ω: angular velocity $T_c$: torque caused by the contact I: moment of inertia $\dot{\omega}$: differential of ω by time.

From the acceleration obtained from the above equation and expressions (16) and (18), the velocity and the position after a minute period of time are obtained.

$$v = v_0 + \ddot{r}\Delta t \tag{22}$$

$$r = r_0 + v_0\Delta t + \tfrac{1}{2}\ddot{r}\Delta t^2 \tag{23}$$

$$\omega = \omega_0 + \dot{\omega}\Delta t \tag{24}$$

where, v: the velocity vector $_0$: the value at present

Δt: a minute period of time.

In the seventh step, these calculations are repeated until the particles stop moving.

EXAMPLE

An example of the calculations according to the flowchart in FIG. 1 is now explained in detail.

Figure 3:
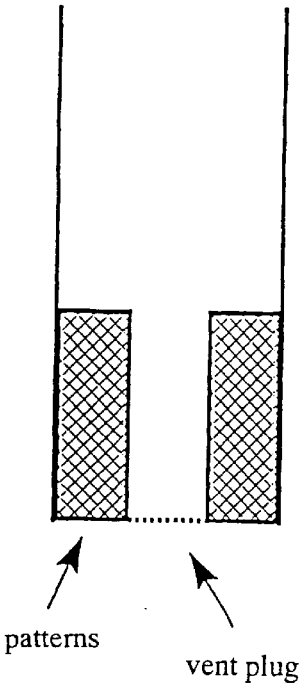
FIG. 3 shows a model of a metal flask and patterns which are used in this invention to make an analysis.

A metal flask and patterns, both used in this example, are shown in FIG. 3. The molding process used here is an airflow-applying-type process with pressurized air being applied to the sand. The physical properties of the green sand and dimensions of the metal flask and patterns are listed in Table 1. The analysis in this example is carried out in two dimensions. The conditions for calculations in the analysis are listed in Table 2.

Figure 4:
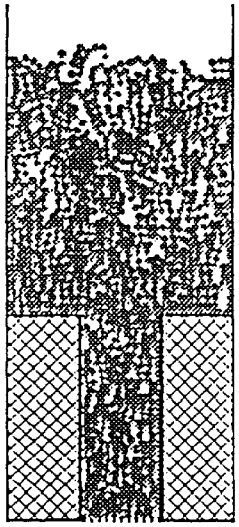
FIG. 4 shows an example of green sand particles freely dropped and filled in the metal flask for the analysis.

In this example the green-sand-molding process of an airflow-type proceeds as is explained below. First, the initial state of the sand particles which were freely dropped into the metal flask shown in FIG. 3 is obtained by numerical calculations. The obtained initial state is shown in FIG. 4. When an air flow is applied from above to the sand particles in the initial state, fluid forces act on the particles. Thus they are moved downward and compacted.

Figure 5:
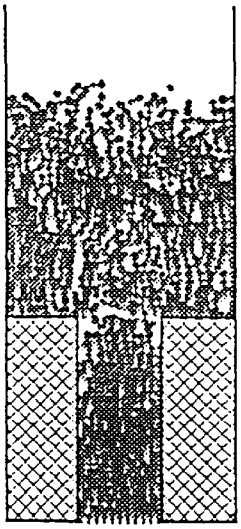
FIG. 5 shows the state of the green sand particles after an air flow is applied to them from above.

This movement is calculated using the above conditions. The results of the calculation are shown in FIG. 5. At the level of the tops of the patterns insufficiently-charged parts are predicted in the green sand located between the patterns. Thus it is assumed that the patterns cannot be successfully removed. Accordingly, the properties of the green sand, molding conditions, molding plan, and molding process, are all changed. Similar calculations will be carried out to obtain the optimum molding conditions, molding plan, and molding process. Although in the example calculations were carried out in a two-dimensional analysis, they may be done in a three-dimensional analysis.

TABLE 1

| | |
|---|---|
| aggregate | Flattery (trademark) |
| compactability [%] | Volclay (trademark) |
| diameter of the particles [m] | $2.29 \times 10^{-4}$ |
| density [kg/m$^3$] | 2500 |
| bond strength [m/s$^2$] | $3.56 \times 10^{-2}$ |
| rebound coefficient | 0.028 |
| shape coefficient of the particles | 0.861 |
| dimensions of the metal flask [mm] | 250 × 110 × 110 |
| dimensions of each pattern [mm] | 100 × 35 × 110 |

TABLE 2

| | |
|---|---|
| the number of elements | 1000 |
| diameter of the elements | $3.0 \times 10^{-3}$ |
| thickness of the layers of bentonite [m] | $3.0 \times 10^{-4}$ |
| Young's modulus of silica sand [MPa] | 7.7 |
| Young's modulus of bentonite [MPa] | 0.7 |
| pressure of the air tank [MPa] | 0.5 |
| time interval [s] | $2.0 \times 10^{-6}$ |

What we claim is:

1. A method of predicting insufficient charging of green sand in a molding process comprising the steps of:

(a) analyzing porosity of green sand in relation to the degree that the green sand is charged;

(b) analyzing contact force acting between sand particles of the green sand;

(c) analyzing fluid force of air existing around the sand particles;

(d) calculating acceleration of the sand particles from the force acting on the sand particles, said force being comprised of said contact force, said fluid force, and the gravity of the particles;

(e) analyzing equations of motion to obtain the velocity and position of the sand particles after a minute period of time, from the calculated acceleration; and (f) repeating said steps (a), (b), (c), (d), and (e) until the sand particles stop moving.

2. The method of claim 1, further comprising a step of analyzing an air flow applied to the green sand to obtain the velocity of the air flow by using data on said porosity obtained in the step of analyzing the porosity.

* * * * *